US010107542B2

(12) United States Patent
Boarman

(10) Patent No.: US 10,107,542 B2
(45) **Date of Patent: *Oct. 23, 2018**

(54) PHASE CHANGE MATERIALS FOR REFRIGERATION AND ICE MAKING

(71) Applicant: WHIRLPOOL CORPORATION, Benton Harbor, MI (US)

(72) Inventor: Patrick J. Boarman, Evansville, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/332,131

(22) Filed: Oct. 24, 2016

(65) Prior Publication Data

US 2017/0102177 A1 Apr. 13, 2017

Related U.S. Application Data

(63) Continuation of application No. 14/601,525, filed on Jan. 21, 2015, now Pat. No. 9,528,730, which is a (Continued)

(51) Int. Cl.
*F25B 21/00* (2006.01)
*F25B 21/02* (2006.01)

(Continued)

(52) U.S. Cl.
CPC ..... *F25D 11/006* (2013.01); *F25B 21/02* (2013.01); *F25D 11/02* (2013.01); *F25D 23/028* (2013.01);

(Continued)

(58) Field of Classification Search
CPC ..... F25B 21/00; F25B 21/02; F25B 21/04; F25B 2321/02; F25B 2321/023;

(Continued)

(56) References Cited

U.S. PATENT DOCUMENTS 2,989,856 A * 6/1961 Telkes ..... F25D 3/00 165/47
3,146,601 A * 9/1964 Gould ..... F25B 21/02 62/3.6

(Continued)

FOREIGN PATENT DOCUMENTS

GB 2304176 A 3/1997
GB 2304179 A * 3/1997 ..... B67D 1/0869
SU 573683 A 9/1977

*Primary Examiner* — Frantz Jules
*Assistant Examiner* — Erik Mendoza-Wilkenfe
(74) *Attorney, Agent, or Firm* — Price Heneveld LLP

(57) ABSTRACT

A bottom mount refrigerator is provided including a thermal battery or phase change material positioned within the refrigerator or freezer in order to increase energy efficiency and compartment sizes of the refrigerator. The thermal battery can be used with an ice maker to aid in removing heat from the water in the ice maker to produce ice. Furthermore, the phase change material or thermal battery may be used with a thermoelectric cooler to aid in ice production. The phase change material may be tuned to various temperatures according to the desired use of the phase change material, as well as the location of the thermal battery or phase change material. Other embodiments include positioning the phase change material in the liner of the compartments or in thermal storage units in order to further increase the energy efficiency of the refrigerator.

5 Claims, 11 Drawing Sheets

Related U.S. Application Data continuation of application No. 13/617,493, filed on Sep. 14, 2012, now Pat. No. 9,016,070.

(51) Int. Cl.

| | |
|---|---|
| ***F25B 21/04*** | (2006.01) |
| ***F25D 17/00*** | (2006.01) |
| ***F25D 19/00*** | (2006.01) |
| ***F25D 11/00*** | (2006.01) |
| ***F25D 11/02*** | (2006.01) |
| ***F25D 23/02*** | (2006.01) |
| ***F25D 23/04*** | (2006.01) |
| ***F25D 23/12*** | (2006.01) |
| *F28D 19/00* | (2006.01) |
| *B67D 3/00* | (2006.01) |
| *F28D 17/00* | (2006.01) |
| *F28D 19/04* | (2006.01) |
| *F28D 19/02* | (2006.01) |
| *F28D 20/00* | (2006.01) |

(52) U.S. Cl.

CPC ..... *F25D 23/04* (2013.01); *F25D 23/126* (2013.01); *B67D 3/0009* (2013.01); *F25B 21/00* (2013.01); *F25B 21/04* (2013.01); *F25C 2400/10* (2013.01); *F25D 2303/08* (2013.01); *F28D 17/00* (2013.01); *F28D 19/00* (2013.01); *F28D 19/02* (2013.01); *F28D 19/04* (2013.01); *F28D 20/00* (2013.01)

(58) Field of Classification Search

CPC ..... F25B 2321/025; F25B 2321/0252; F25D 11/006; F25D 23/068; F25D 31/002; F25D 31/005; F25D 3/005; F25D 2303/08; F25D 2303/82; F25D 2303/083; F25D 2303/084; F25C 2400/14; F25C 2400/10; F28D 17/00; F28D 17/005; F28D 19/00; F28D 19/02; F28D 19/04; F28D 20/00; F28D 20/0056; B67D 3/0009

See application file for complete search history.

(56) References Cited

U.S. PATENT DOCUMENTS

| | | | | |
|---|---|---|---|---|
| 3,192,726 | A | 7/1965 | Newton | |
| 3,984,223 | A | 10/1976 | Whistler, Jr. | |
| 4,250,958 | A * | 2/1981 | Wasserman | F28D 20/02 126/618 |
| 4,416,119 | A | 11/1983 | Wilson et al. | |
| 4,777,930 | A | 10/1988 | Hartz | |
| 4,821,914 | A | 4/1989 | Owen | |
| 4,827,735 | A | 5/1989 | Foley | |
| 4,954,278 | A * | 9/1990 | MacCracken | C09K 5/06 165/10 |
| 5,092,129 | A | 3/1992 | Bayes et al. | |
| 5,251,455 | A | 10/1993 | Cur et al. | |
| 5,261,247 | A | 11/1993 | Knezic et al. | |
| 5,377,498 | A | 1/1995 | Cur et al. | |
| 5,505,046 | A | 4/1996 | Nelson et al. | |
| 5,522,216 | A | 6/1996 | Park et al. | |
| 6,253,563 | B1 | 7/2001 | Ewert | |
| 6,327,871 | B1 | 12/2001 | Rafalovich | |
| 6,393,861 | B1 | 5/2002 | Levenduski | |
| 6,453,693 | B1 | 9/2002 | Ewert | |
| 6,469,487 | B2 | 10/2002 | Ewert | |
| 6,481,216 | B2 | 11/2002 | Swimmons et al. | |
| 7,216,499 | B2 | 5/2007 | Flinner et al. | |
| 7,246,496 | B2 | 7/2007 | Goenjka et al. | |
| 7,266,962 | B2 | 9/2007 | Montuoro et al. | |
| 7,299,640 | B2 | 11/2007 | Beck | |
| 7,444,830 | B2 | 11/2008 | Moran et al. | |
| 7,942,018 | B2 | 5/2011 | Niu et al. | |
| 8,056,359 | B2 | 11/2011 | Smith et al. | |
| 9,528,730 | B2 * | 12/2016 | Boarman | F25D 11/006 |
| 2002/0162339 | A1 | 11/2002 | Harrison et al. | |
| 2003/0188540 | A1 | 10/2003 | Van Winkle | |
| 2004/0011077 | A1 | 1/2004 | Maidment | |
| 2005/0092473 | A1 | 5/2005 | Smithey et al. | |
| 2005/0167169 | A1 | 8/2005 | Gering et al. | |
| 2006/0260345 | A1 | 11/2006 | Coulter et al. | |
| 2007/0074527 | A1 | 4/2007 | Lee et al. | |
| 2008/0010999 | A1 * | 1/2008 | Sonnenrein | C09K 5/066 62/3.64 |
| 2008/0011013 | A1 | 1/2008 | Junge | |
| 2008/0034760 | A1 | 2/2008 | Narayanamurthy et al. | |
| 2008/0148763 | A1 * | 6/2008 | Boarman | F25D 23/126 62/389 |
| 2008/0282705 | A1 | 11/2008 | Hue et al. | |
| 2009/0183515 | A1 | 7/2009 | Hale et al. | |
| 2009/0191804 | A1 | 7/2009 | Goenka et al. | |
| 2010/0126185 | A1 * | 5/2010 | Cho | F25C 5/005 62/3.63 |
| 2010/0186423 | A1 | 7/2010 | Veltrop et al. | |
| 2011/0259041 | A1 | 10/2011 | Kuehl et al. | |
| 2011/0315783 | A1 * | 12/2011 | Baker | B01L 7/52 236/3 |
| 2012/0096872 | A1 * | 4/2012 | Cheong | F25C 5/005 62/3.3 |
| 2012/0152511 | A1 * | 6/2012 | Chang | B60H 1/00428 165/202 |
| 2012/0167596 | A1 * | 7/2012 | Krause | F25B 21/04 62/3.2 |
| 2012/0174598 | A1 | 7/2012 | Brandes et al. | |
| 2013/0019623 | A1 | 1/2013 | Jo et al. | |
| 2013/0047652 | A1 | 2/2013 | Lee et al. | |
| 2013/0160484 | A1 | 6/2013 | Lee et al. | |
| 2015/0033764 | A1 * | 2/2015 | Gurevich | F25B 21/02 62/3.6 |

* cited by examiner

PHASE CHANGE MATERIALS FOR REFRIGERATION AND ICE MAKING

CROSS-REFERENCE TO RELATED APPLICATIONS

This is a Continuation Application of U.S. application Ser. No. 14/601,525, filed on Jan. 21, 2015, and now U.S. Pat. No. 9,528,730, which is a Continuation Application of U.S. application Ser. No. 13/617,493, filed on Sep. 14, 2012, and now U.S. Pat. No. 9,016,070, issued on Apr. 28, 2015, the entire disclosures of which are expressly incorporated herein by reference.

FIELD OF THE INVENTION

The present invention relates generally to refrigerators. More particularly, but not exclusively, the invention relates to a refrigerator including a thermal battery to aid in cooling processes, such as in cooling an icemaker.

BACKGROUND OF THE INVENTION

Bottom mount refrigerators include a freezer compartment on the bottom, with the fresh food or refrigerated compartment above the freezer compartment. One or more doors provide access to the fresh food compartment, and a separate door provides access to the freezer compartment. Generally, an ice maker is positioned near the upper area of the fresh food compartment. The ice maker receives water from a water line, and cold air from the freezer compartment is directed over the water to freeze the water, forming ice. The ice may then be directed to a reservoir or ice container, which can be located on a door of the fresh food compartment adjacent a dispenser, or at the top of the fresh food compartment, near the ice maker.

Placing the ice maker, and potentially the ice container, within the fresh food compartment reduces the amount of available space within the fresh food compartment for food storage. Furthermore, cooling the water in the ice maker via cold air directed from the freezer compartment increases the amount of energy used by the refrigerator. The cooling loop of the refrigerator must take more heat from the freezer compartment to create enough cold air within the freezer compartment to cool the compartment and to cool the water in the ice maker. There is increased energy consumption by the use of a fan that directs the cooled air to the ice maker, which also creates the possibility that the cooled air may warm or escape, creating the need for even more cooled air in the freezer compartment.

Therefore, there is a need in the art for a refrigerator having an ice making system on a door that provides access to the fresh food compartment. There is also a need in the art for a system and method of cooling the water of the ice making system that does not require cold air from the freezer compartment.

SUMMARY OF THE INVENTION

Therefore, it is principal object, feature, and/or advantage of the present invention to provide an apparatus that overcomes the deficiencies in the art.

It is another object, feature, and/or advantage of the present invention to provide a refrigerator having an ice maker on one of the doors providing access to the fresh food compartment.

It is still another object, feature, and/or advantage of the present invention to provide a refrigerator having an ice maker that is cooled by a thermoelectric cooler.

It is yet another object, feature, and/or advantage of the present invention to provide a refrigerator ice making loop that takes heat from the thermoelectric cooler by the use of a phase change material.

It is a further object, feature, and/or advantage of the present invention to provide a thermal battery in the refrigerator.

It is still a further object, feature, and/or advantage of the present invention to provide a refrigerator that does not use air from the freezer compartment to cool water in an ice maker to form ice.

It is another object, feature, and/or advantage of the present invention to provide a plurality of thermal batteries comprising phase change materials having various temperature settings throughout the refrigerator.

It is still another object, feature, and/or advantage of the present invention to provide a phase change material to provide cooled air to the ice maker.

These and/or other objects, features, and advantages of the present invention will be apparent to those skilled in the art. The present invention is not to be limited to or by these objects, features and advantages. No single embodiment need provide each and every object, feature, or advantage.

According to one aspect of the present invention, a refrigerator is provided. The refrigerator includes a cabinet. A fresh food compartment is positioned within the cabinet. A freezer compartment is positioned below the fresh food compartment in the cabinet. A fresh food door provides access to the fresh food compartment. A thermoelectric cooler is positioned on the fresh food door, and a thermal battery is positioned in communication with the thermoelectric cooler.

According to another aspect of the present invention, a refrigerator is provided. The refrigerator includes a cabinet. A fresh food compartment is positioned within the cabinet. A freezer compartment is positioned below the fresh food compartment in the cabinet. A fresh food door provides access to the fresh food compartment. A thermoelectric cooler is positioned on the fresh food door. An ice maker is positioned on the fresh food door and includes a cooling loop in communication with the thermoelectric cooler. A thermal battery is positioned on the fresh food door adjacent the thermoelectric cooler to absorb heat from the thermoelectric cooler.

According to still another aspect of the present invention, a refrigerator is provided. The refrigerator includes a cabinet. A fresh food compartment is positioned within the cabinet. A freezer compartment is positioned below the fresh food compartment in the cabinet. A fresh food door provides access to the fresh food compartment. An ice maker is positioned on the fresh food door. A thermal battery is positioned in the cabinet, and the thermal battery provides cooled air to cool the ice maker to form ice.

DETAILED DESCRIPTION OF THE PREFERRED EMBODIMENTS

Figure 1:
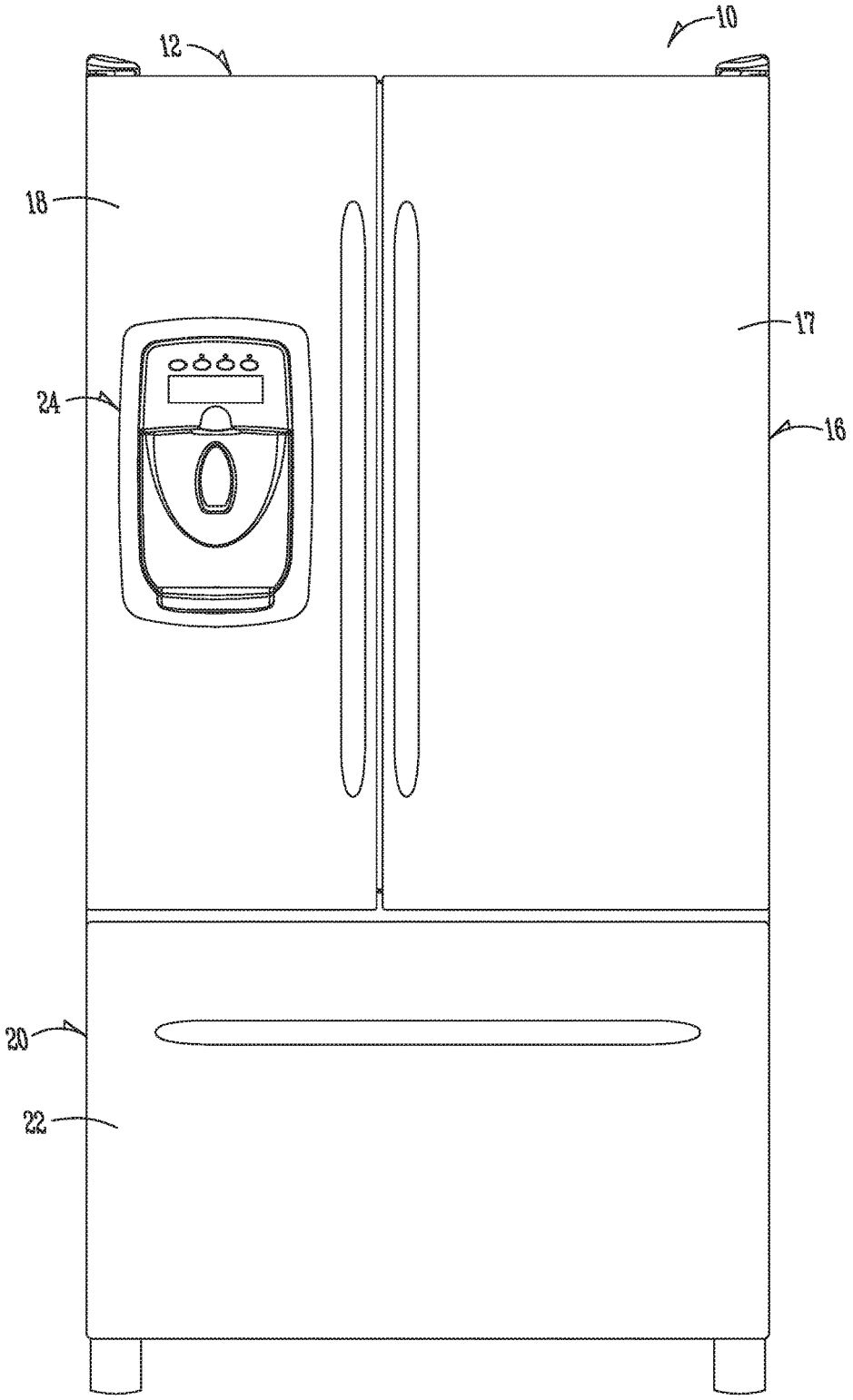
FIG. 1 is a front elevation view of a bottom mount refrigerator.

FIG. 1 is a front elevation view of a bottom mount refrigerator 10. The bottom mount refrigerator 10 includes a cabinet 12 encapsulating the refrigerator compartments. The upper compartment is a fresh food compartment 16. First and second doors 17, 18 provide access to the interior of the fresh food compartment 16. As shown in FIG. 1, a dispenser 24 is positioned on one of the doors 17, 18 of the fresh food compartment 16. The dispenser 24 may be a water dispenser, ice dispenser, other beverage dispenser, or some combination thereof. Furthermore, the dispenser 24 may be placed on either door, or the present invention does not require a dispenser on the exterior door of any of the compartments. Positioned generally below the fresh food compartment 16 is a freezer compartment 20. A freezer door 22 provides access to the freezer compartment 20. The freezer door 22 of FIG. 1 is shown as a drawer-type door. However, the present invention contemplates that the freezer door 22 may be a drawer or a hinged door.

Figure 2:
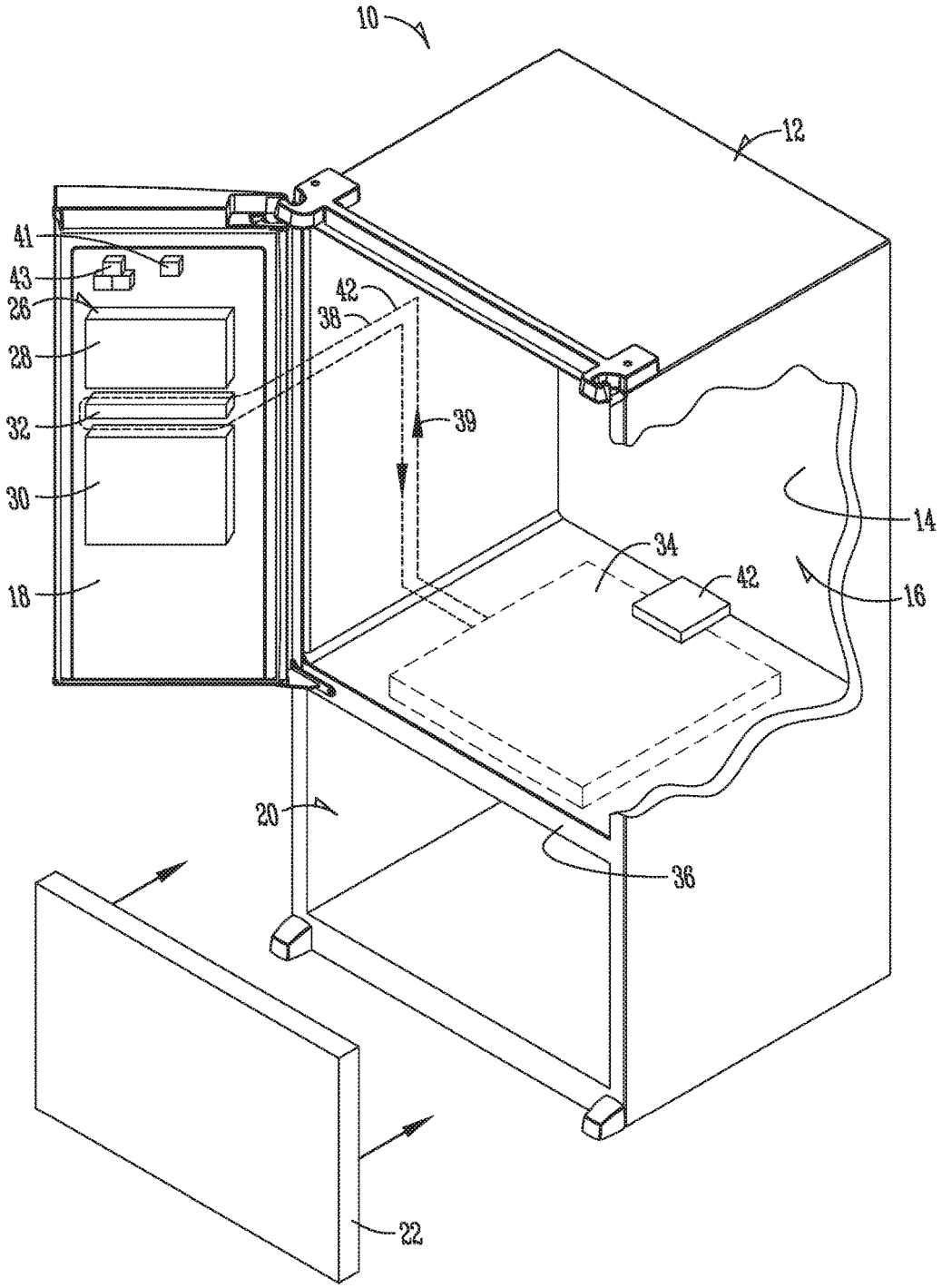
FIG. 2 is a perspective view of the bottom mount refrigerator of FIG. 1 having the refrigerator doors opened and thermal battery in the mullion between the freezer and fresh food compartments.

FIG. 2 is a perspective view of the refrigerator 10 of FIG. 1 having the fresh food door 18 open, the fresh food door 17 removed, and the freezer door 22 exploded away from the freezer compartment 20. Furthermore, a section of the refrigerator cabinet 12 is removed to show the interior of the fresh food compartment 16, including the liner 14 of the compartment.

FIG. 2 shows a refrigerator 10 having an ice making system 26 positioned on the interior of the fresh food door 18. The ice making system 26 includes an ice maker 28, a thermoelectric cooler 32, and an ice container 30 positioned generally below the ice maker 28. Other components positioned on the interior of the door include a pump 41 and a valve 43, which may be a water valve. The ice making system 26 is positioned on the door of the fresh food compartment 16 in order to preserve space within the fresh food compartment 16. Having the ice maker 28 on the door allows for more shelving (not shown) to be positioned within the fresh food compartment 16, including near the upper portion of the fresh food compartment 16. The thermoelectric cooler 32 provides a cooling source wherein a heat absorption source for the ice maker 28 in order for the ice maker 28 to remove heat from the water in the ice maker 28 to form the ice cubes. However, the thermoelectric cooler 32 will absorb heat on one side, while expelling heat on the opposite side of the thermoelectric cooler 32. Thus, a heat sink or heat absorption must be included for the refrigerator 10 in order that the thermoelectric cooler 32 does not overheat, which could damage other components of the refrigerator 10. Therefore, in the embodiment shown in FIG. 2, a thermal battery 34 is positioned in the refrigerator 10. In particular, the thermal battery 34 is positioned in the mullion between the fresh food compartment 16 and the freezer compartment 20. However, the present invention contemplates that the thermal battery 34 may be positioned anywhere within the refrigerator 10 as space may allow. The location of the thermal battery 34 is not pertinent to the present invention.

The thermal battery 34 comprises a phase change material (PCM). The PCM is a material that may be tuned to melt at a specified or desired temperature. Thus, the PCM absorbs heat from another object until the tuned temperature of the PCM is reached. At that point, the PCM begins to melt and the PCM no longer absorbs heat from an adjacent element. For the embodiment shown in FIG. 2, the thermal battery 34 comprises a PCM that is tuned to a temperature range between 34° and 38° F. As stated above, the PCM will have a melting temperature between 34° and 38° F. Therefore, one example of a PCM to use as a thermal battery 34 in the embodiment shown in FIG. 2 may be PureTemp 4, which may be purchased from Entropy Solutions, Inc., 151 Cheshire Lane, Suite 400, Plymouth, Minn. 55441. However, the present invention contemplates other model numbers and manufacturers of PCMs that may be used with the present invention.

The thermal battery 34 and ice making system 26 of FIG. 2 work as follows. The thermoelectric cooler 32 is energized by electricity or other energy source. The powering of the thermoelectric cooler 32 cools one side while raising the temperature of the opposite side. Thus, the cool side is positioned adjacent the ice maker 28. As water is added to the ice maker 28, the heat of the water is absorbed by the cool side of the thermoelectric cooler 32 to reduce the temperature of the water to below freezing, thus forming ice cubes. The ice cubes are then ejected into the ice container 30. In order to prevent the thermoelectric cooler 32 from overheating from the absorption of too much heat, a cooling loop 38 is added between the thermal battery 34 and the thermoelectric cooler 32. The cooling loop 38 moves in a direction generally shown by the arrow 39 of FIG. 2. The cooling loop 38 includes a coolant, which may be water. The coolant is passed from the thermal battery 34 to the heated or warm side of the thermoelectric cooler 32 to absorb heat and act as a heat sink for the thermoelectric cooler 32. The warmed water will then be directed back to the thermal battery 34 where the thermal battery 34 will absorb heat from the water, thus re-cooling the water to a lower temperature. Once the re-cooled water has passed the thermal battery 34, the thermal battery 34 is allowed to recharge. The thermal battery 34 may be recharged by the use of a fan 42 positioned at either the fresh food compartment 16 or the freezer compartment 20. The fan 42 will be activated to quickly remove heat from the thermal battery 34. Thus, when the warmed water passes the thermal battery 34, the phase change material or PCM will begin to melt. Once the fan 42 is activated to remove the heat, the PCM will refreeze to a solid state. At the fully solid state, the thermal battery 34 is fully recharged and ready to have more warm water pass adjacent the thermal battery 34 to remove heat from the warmed water. The cycle is repeated as is needed to continually produce ice at the ice maker 28.

Figure 3:
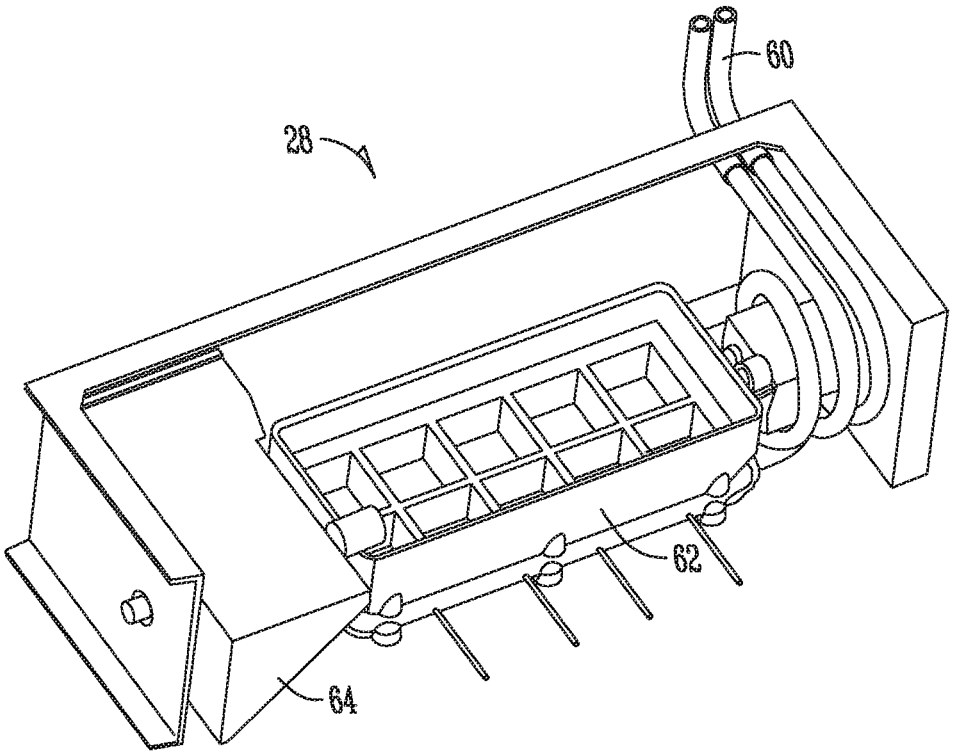
FIG. 3 is a perspective view of the ice maker according to an embodiment of the present invention.

FIG. 3 is a perspective view of an ice maker 28 that may be used with the PCM and thermal battery 34 of the present invention. The ice maker 28 includes an ice tray 62, an ice cooling loop 60, and a rocker 64. The ice maker 28 is positioned directly adjacent the thermoelectric cooler 32 such that the thermoelectric cooler 32 absorbs heat from the water in the ice maker 28 to produce ice cubes. Furthermore, the ice maker 28 is gently rocked by the rocker 64 to remove bubbles in the water during the freezing process in order to make clear ice. While one embodiment of an ice maker 28 has been shown for the present invention, it is contemplated that other ice makers will be used, which are known in the art and which may be invented.

Figure 4:
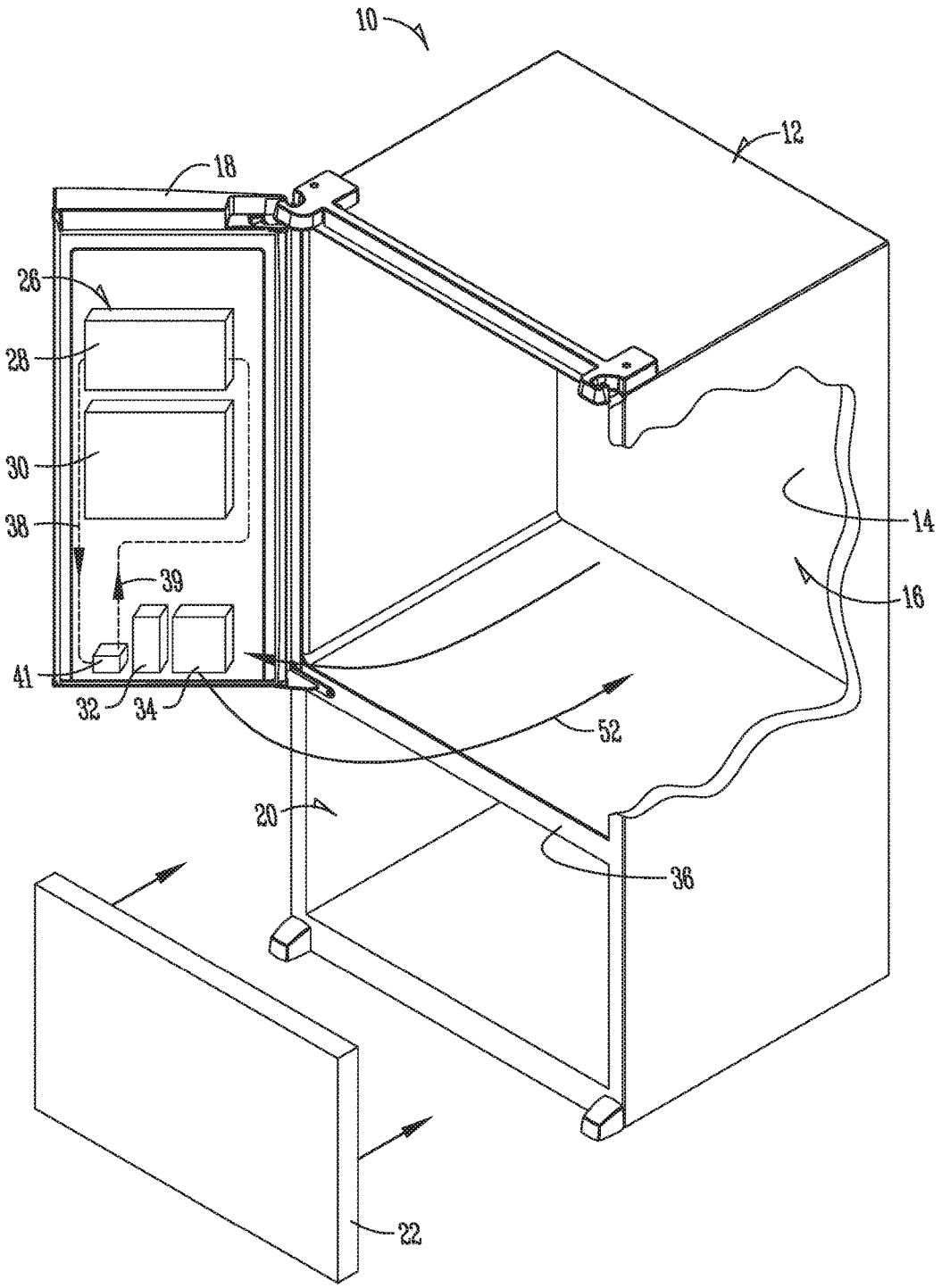
FIG. 4 is a perspective view of another embodiment of the refrigerator with the thermal battery positioned on a fresh food door.

FIG. 4 is a perspective view of another embodiment of the refrigerator 10 and ice making system 26 positioned on the fresh food door 18. In the embodiment shown in FIG. 4, the thermal battery 34 is positioned adjacent the thermoelectric cooler 32 on the door of the refrigerator 10. In this embodiment, a cooling loop 38 is positioned between the thermoelectric cooler 32 and the ice maker 28 with a coolant 40 being passed via pump 41 on the door. The coolant may be glycol or other coolant with a lower freezing point or freezing temperature than water.

Like the embodiment above, the ice maker 28 works in conjunction with the thermoelectric cooler 32. The thermoelectric cooler 32 includes a cold side and a hot side. The cooling loop 38 is passed adjacent the cooled or cold side of the thermoelectric cooler 32 and is passed in the direction generally shown by the arrow 39. The coolant 40 is passed through the ice maker 28 and more specifically adjacent the ice tray 62 to remove heat from water in the ice tray 62 to form ice. The ice or ice cubes are then ejected into the ice container 30, which is shown to be positioned below the ice maker 28 on the fresh food door 18. The coolant 40 will have a warmer temperature and will need to be re-cooled by the thermoelectric cooler 32. As the thermoelectric cooler 32 will need to expel heat, the thermal battery 34 acts as a heat sink to remove heat from the warm side of the thermoelectric cooler 32. The thermal battery 34 comprises a PCM, which may have a melting temperature tuned to approximately 40° F. However, it should be appreciated that the melting temperature may be within the range of 34° to 42° F. Thus, the PCM of the thermal battery 34 will begin to melt at the tuned temperature as it removes or absorbs heat from the warm side of the thermoelectric cooler 32. To recharge the thermal battery 34 (to refreeze the PCM), the system will use the ambient air temperature inside the fresh food compartment 16. As the fresh food compartment 16 is generally set to a temperature below the tuned temperature of the PCM, the ambient air will be passed from the thermal battery 34 and the fresh food compartment 16 as shown generally by the arrow 52. As the air inside the fresh food compartment 16 is lower than the freezing temperature of the thermal battery 34, the air will work to recharge and refreeze the battery as needed.

Figure 5:
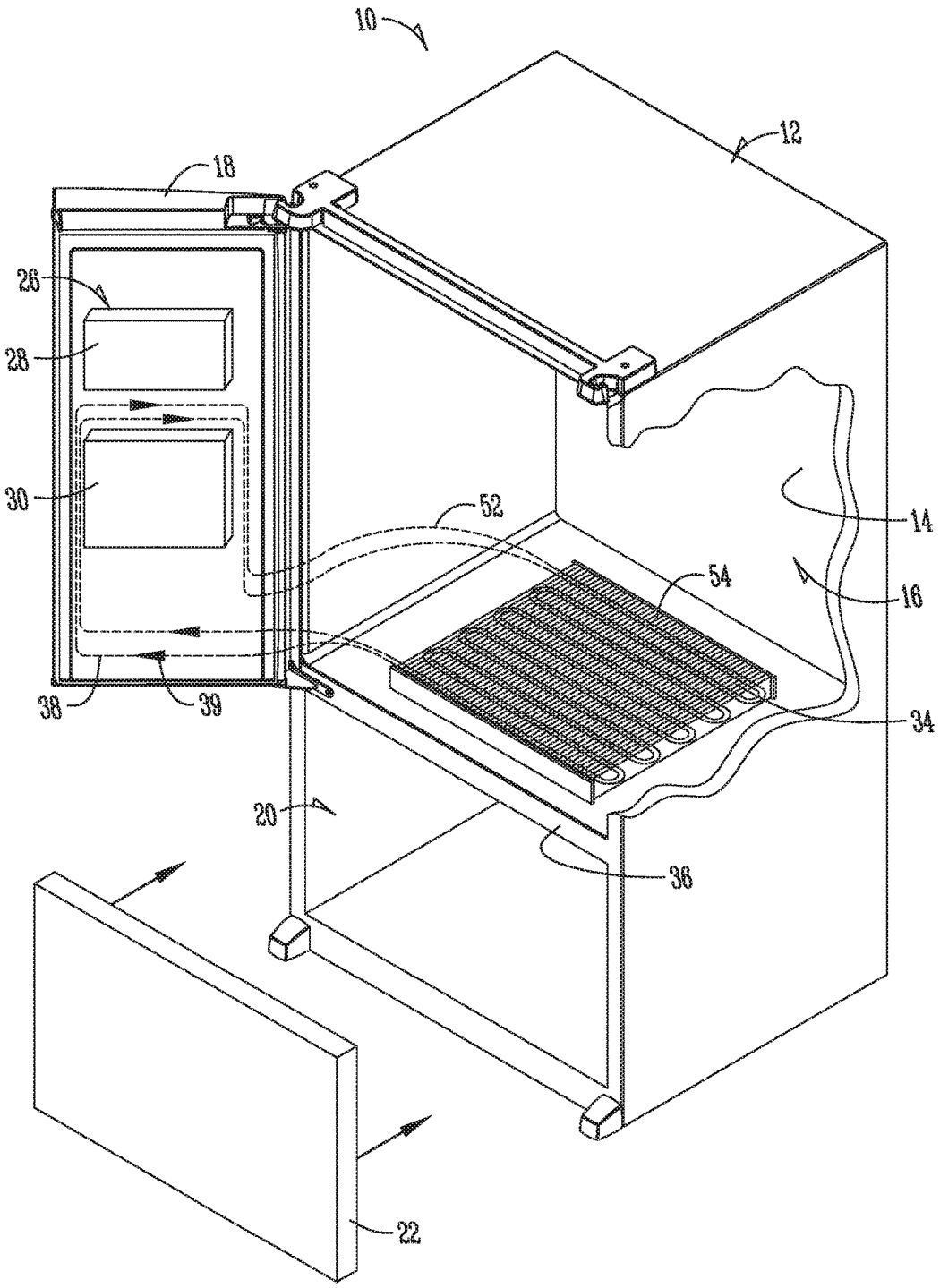
FIG. 5 is a perspective view of another embodiment of the refrigerator with the thermal battery positioned in the mullion between the freezer and fresh food compartments.

FIG. 5 is a perspective view of another embodiment of the refrigerator 10 with the thermal battery 34 positioned in the mullion 36 between the freezer compartment 20 and the fresh food compartment 16. The embodiment is similar to the embodiment shown in FIG. 2. The icemaking system 26, including an ice maker 28 and ice container 30, is positioned on the interior of the fresh food door 18. However, in this embodiment, the ice maker 28 is cooled by a cooling loop 38 comprising an air loop 52 between the thermal battery 34 and the ice maker 28. The thermal battery 34 of FIG. 5 comprises a PCM having a melting temperature less than 32° F. Furthermore, the thermal battery 34 will include an evaporator coil or fins 54 through the battery 34. The air is cooled at the thermal battery 34 to a temperature below 32° F. and is directed to the ice maker 28 to remove heat from the water in the ice maker 28 to produce ice. As the air at the ice maker 28 absorbs the heat, it becomes warmer. This warm air is then directed back to the thermal battery 34, which absorbs the warmer temperature of the air, thus re-cooling the air to be directed back towards the ice maker 28. The thermal battery 34 is recharged by the air in the freezer compartment 20, which is generally below freezing or 32° F. Thus, the embodiment shown in FIG. 5 reduces the amount of components needed to lower the temperature of water in the ice maker 28 to produce ice. However, other components not shown in FIG. 5 may be included, such as a fan 42.

Figure 6:
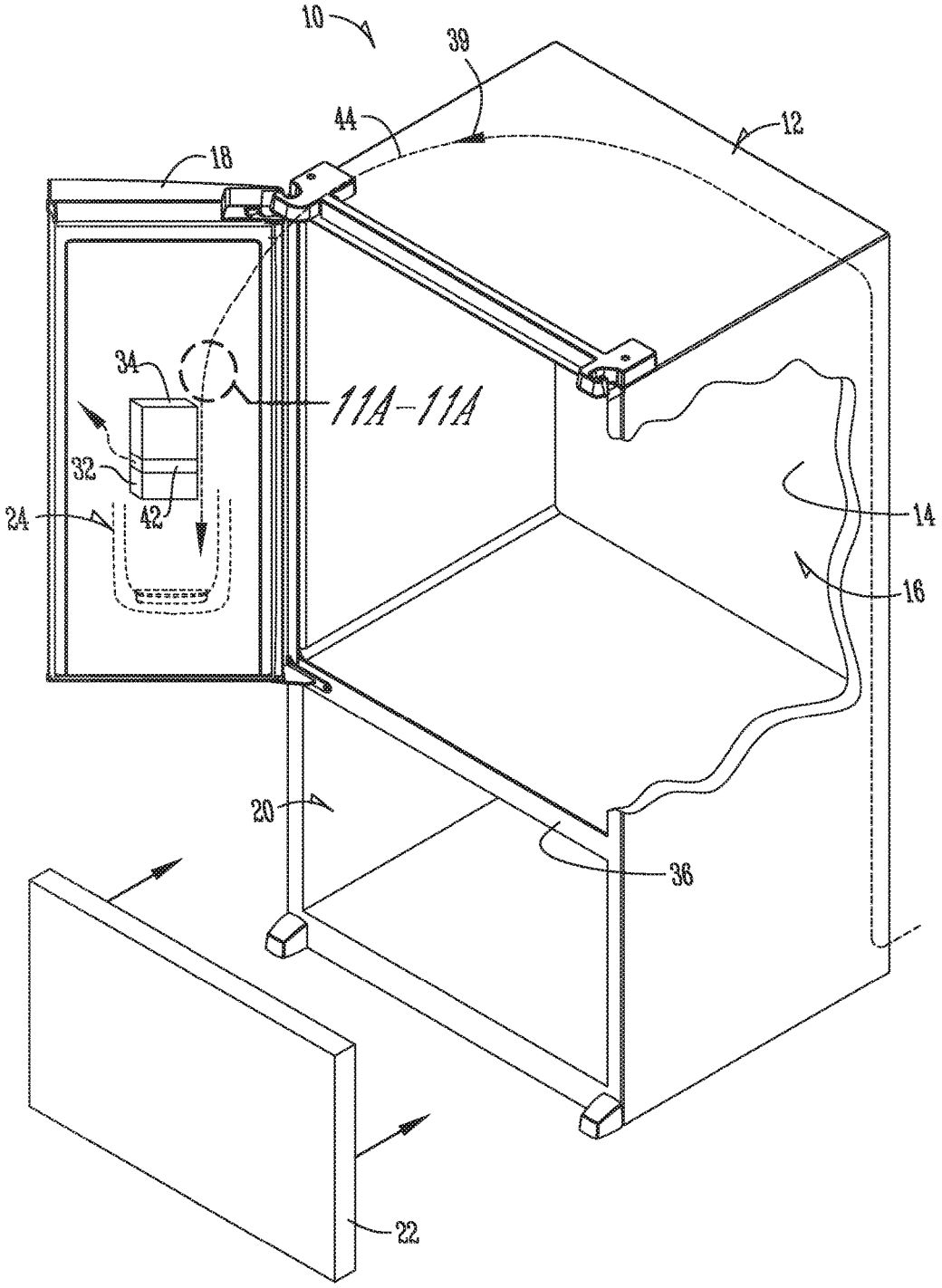
FIG. 6 is a perspective view of the refrigerator with the thermal battery in contact with the water line of a dispenser.

FIG. 6 is a perspective view of a refrigerator 10 according to another embodiment of the invention. The refrigerator 10 of FIG. 6 has a thermal battery 34 positioned on the interior of the fresh food door 18. The thermal battery 34 comprises a PCM tuned to approximately 40° F. Thus, the PCM is tuned to have a melting temperature approximately 40° F. The water line 44 for the dispenser 24 on the door 18 on the refrigerator 10 is positioned to pass adjacent the thermal battery 34 before ending at the dispenser 24. Thus, the water passing through the water line 44 may be quickly cooled via the thermal battery 34 before being dispensed. As the temperature of the water is greater than the melting temperature or tuned temperature of the PCM of the thermal battery 34, the thermal battery 34 will remove heat from the water as it passes adjacent the thermal battery 34 to cool the water. In order to decrease the amount of cooling time required to cool the water, a thermoelectric cooler 32 may also be positioned and used to cool the water, with the thermal battery 34 acting as a heat sink for the thermoelectric cooler 32. It should be appreciated that the embodiment of quick cooling the water before being dispensed may be accomplished with or without the thermoelectric cooler 32. Therefore, the thermal battery 34 may be the only cooling component for the water. It should also be appreciated that the melting temperature of the PCM comprising the thermal battery 34 may be lowered if the temperature of the output water through the dispenser 24 is desired to be a lower temperature.

Figure 7:
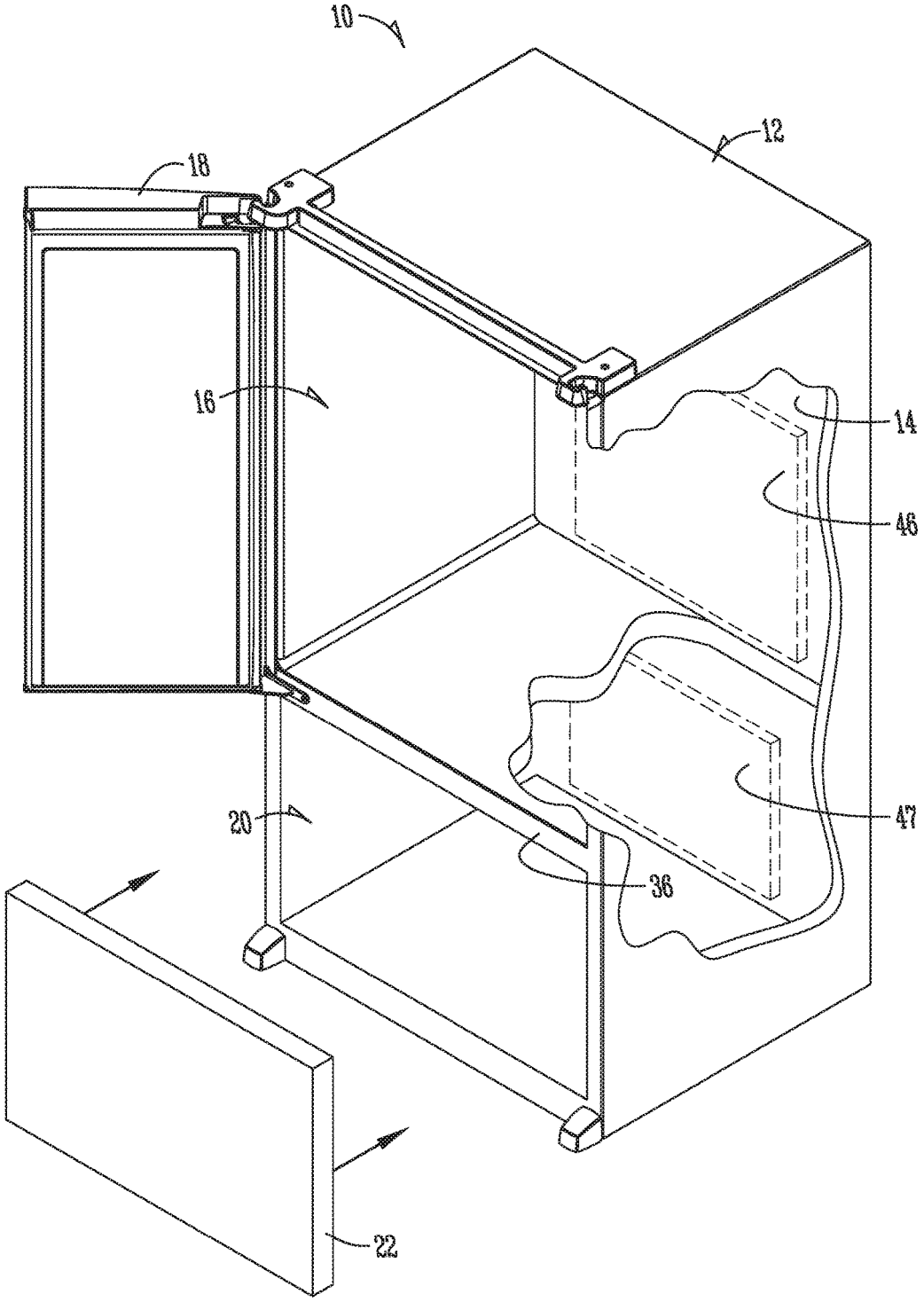
FIG. 7 is a perspective view of the refrigerator with a phase change material embedded in the liner of the fresh food and freezer compartments.

FIG. 7 is a perspective view of a refrigerator 10 having the liner 14 of the fresh food compartment 16 and the freezer compartment 20 lined with a PCM. The liner 14 of the fresh food compartment 16 will comprise a PCM tuned to a temperature approximately 40°. The liner 14 of the freezer compartment 20 will comprise a material having a tuned temperature or melting point of 0° F. All of the walls of the refrigerator compartment and freezer compartment will be impregnated with the PCMs, and the PCMs will be recharged by the ambient air within the fresh food compartment 16 and freezer compartment 20. Thus, the PCM 46 of the fresh food compartment 16 will aid in maintaining the temperature within the fresh food compartment 16 even if the one or more of the fresh food doors 17, 18 are left open. Thus, the PCM 46 in the liner of the fresh food compartment 16 will increase the energy efficiency of the refrigerator 10 by not having the cooling loop 38 of the refrigerator 10 running constantly while one or more doors are open. Likewise, the PCM 47 in the freezer compartment liner will aid in keeping the ambient temperature within the freezer compartment 20 at or near 0° F. Thus, if the freezer door 22 is left open for a longer period of time, the PCM 47 will aid in maintaining the temperature of the freezer compartment 20 without having to run the refrigerator 10 cooling loop 38.

Figure 8:
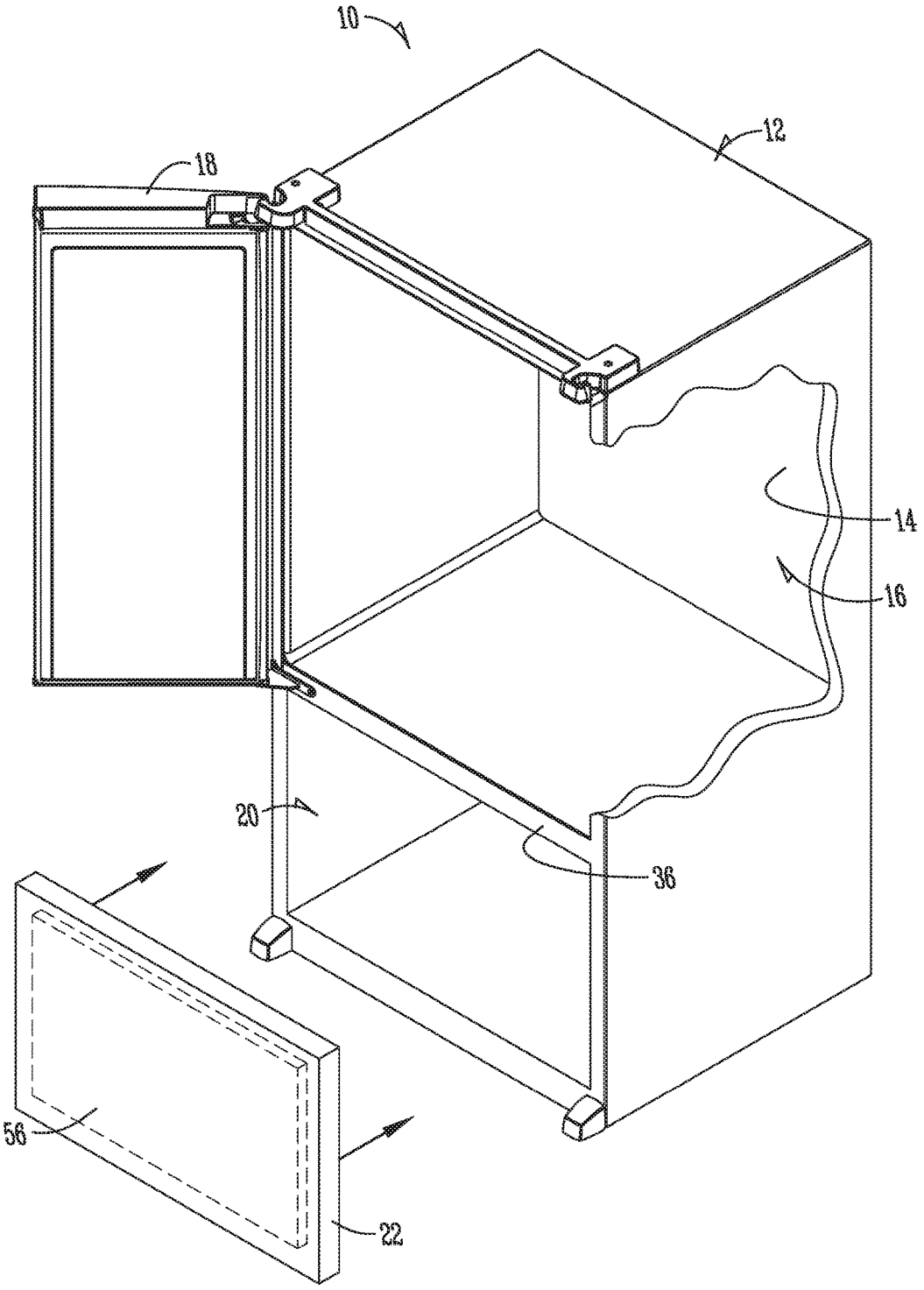
FIG. 8 is a perspective view of the refrigerator with a phase change material embedded in the cabinet of the refrigerator.

FIG. 8 is a perspective view of a refrigerator 10 according to another embodiment of the present invention. The refrigerator 10 of FIG. 8 includes a PCM embedded in the exterior wall or cabinet 12 of the refrigerator 10. Thus, all of the exterior walls, including the doors and cabinet of the refrigerator 10 will be impregnated with a PCM tuned to a temperature approximately 60° F. Thus, the PCM lined exterior walls and cabinet will not sweat. However, in this embodiment, the PCM will have a freezing temperature at 60° F. such that if the outer walls or exterior walls of the refrigerator 10 dip below 60° F., and the dew point is less than 60° F., the refrigerator 10 may still sweat.

Figure 9:
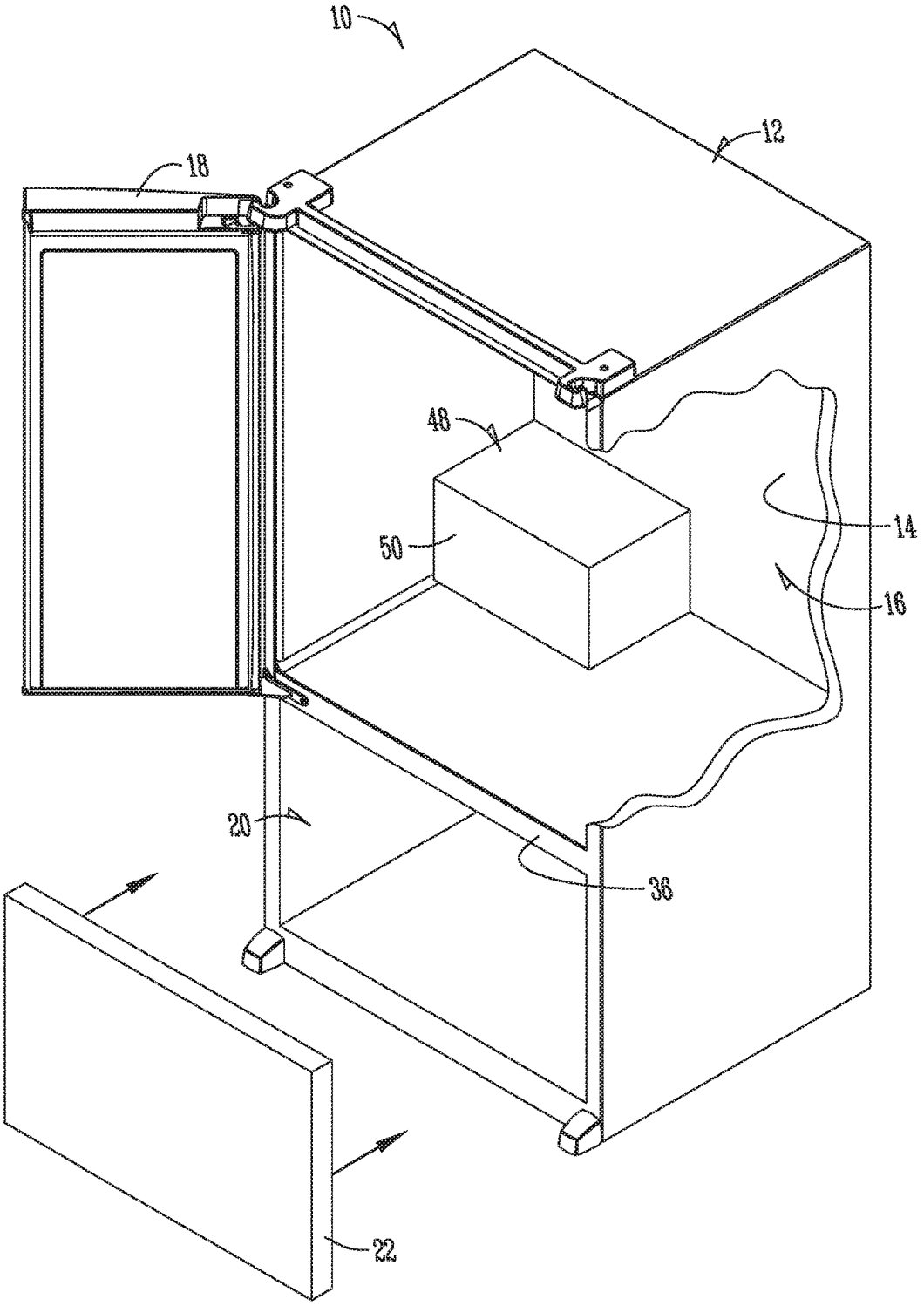
FIG. 9 is a perspective view of the refrigerator with a thermal storage unit positioned in the fresh food compartment.
Figure 10:
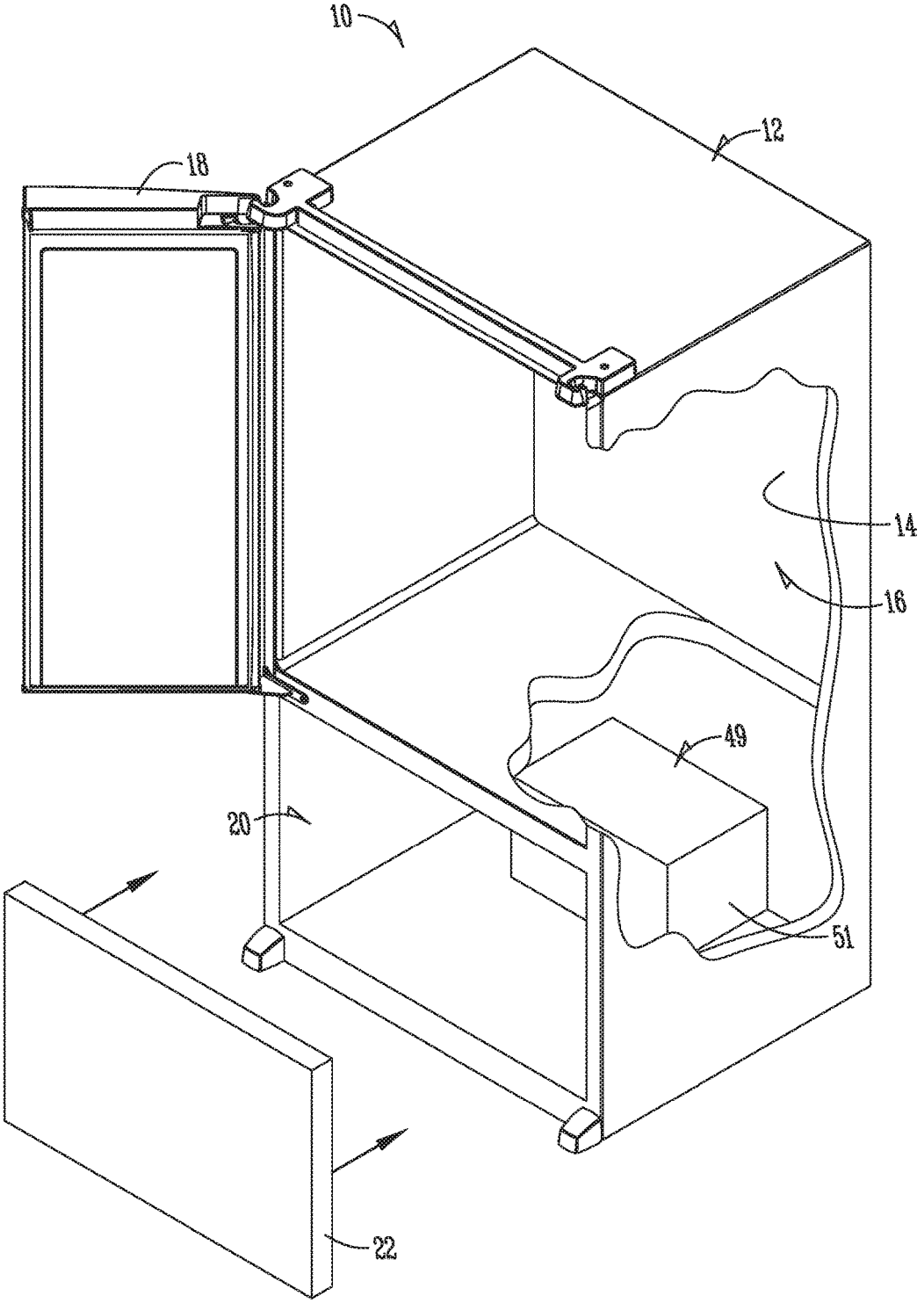
FIG. 10 is a perspective view of the refrigerator with a thermal storage unit positioned in the freezer compartment.

FIGS. 9 and 10 are views of the refrigerator 10 according to yet another embodiment of the present invention. The refrigerators shown in FIGS. 9 and 10 include thermal storage units 49, 48 positioned in the fresh food compartment 16 and the freezer compartment 20 of the refrigerator 10. The thermal storage unit 48 positioned in the fresh food compartment 16 will include walls 50 comprising a PCM tuned to approximately 33° F. Furthermore, at least one of the walls 50 of the thermal storage unit 48 will allow access to within the thermal storage unit 48. Thus, any item within or contained in the thermal storage unit 48 will be prevented from freezing. Therefore, a coiled tube reservoir may be placed within the box, or even perishables. Alternatively, the thermal storage unit 49 positioned in the freezer compartment 20 will be made of a shroud impregnated with a PCM tuned to approximately 10° F. Thus, the thermal storage unit 49 will protect items contained in the thermal storage unit 49 from elevated temperatures during cycling and will ensure that the temperatures remain below 10°. Thus, items will remain frozen or near frozen even if the freezer is left open.

Figure 11A:
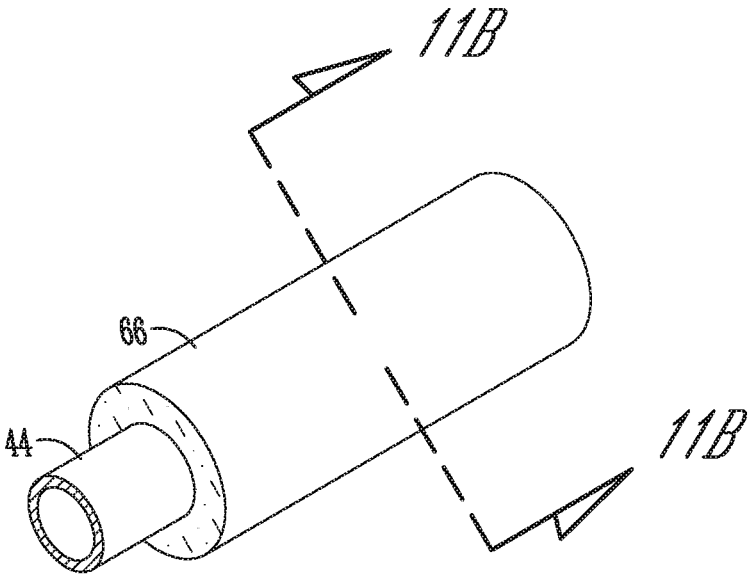
FIG. 11A is a view of a water line surrounded by a tube of phase change material that can be used with the refrigerator of the present invention.
Figure 11B:
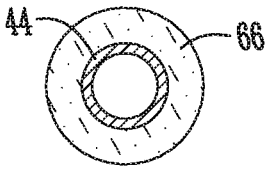
FIG. 11B is a cross-sectional view of the water line of FIG. 11A.

FIGS. 11A and 11B are views of an embodiment of the water line 44 shown in FIG. 6. To prevent the water line 44 from freezing, the line may be surrounded by a PCM tube 66. The PCM tube 66 can be a liquid tuned to approximately 32-34° F. Therefore, the PCM in the tube 66 would not start freezing until the temperature of the water in the water line 44 gets below that temperature. The heat of fusion required for the outer tube 66 to freeze will prevent the inner tube 44 from freezing. Thus, an addition of the outer tube 66 will provide at least short term relief to prevent the line 44 from freezing. It should be appreciated that the tuned temperature of the PCM in the outer tube 66 could be varied to provide greater length of time that the outer tube 66 could prevent freezing of the inner tube 44. However, it should be noted that the refrigerator 10 and water line 44 of the present invention does not require the outer PCM tube 66, and the addition of the tube 66 does not limit the invention. Additionally, a PCM tuned to both temperatures below and above that mentioned are considered to be a part of the invention.

The foregoing description has been presented for purposes of illustration and description, and is not intended to be exhausted or to limit the invention to the precise forms disclosed. It is contemplated that other alternative processes obvious to those skilled in the art are considered to be included in the invention. The description is merely examples of embodiments. For example, the tuned temperatures of the various PCMs used in the embodiments may be varied according to user demands and energy requirements.

Thus, the tuned temperature may be lowered or raised depending on actual use. Furthermore, the location of the various PCMs and thermal batteries may be varied according to make and model of refrigerator. Likewise, the shape, size and location of the thermal storage units may be varied as well. It is understood that many other modifications, substitutions, and additions may be made which are within the intended spirit and scope of the invention. From the foregoing, it can be seen that the present invention accomplishes at least all the stated objections.

What is claimed is:

1. A refrigerator, comprising:

a cabinet;

a door providing access to within the cabinet;

a thermoelectric cooler positioned on the door;

a first thermal battery in thermal communication with the thermoelectric cooler;

the first thermal battery comprising a phase change material that is configured to cool a liquid coolant that has been warmed by the thermoelectric cooler, the liquid coolant flowing in a recirculating path between the first thermal battery and the thermoelectric cooler;

the first thermal battery being cooled by air cooled at least partially by a cooling loop of the refrigerator;

a second thermal battery positioned on the interior of the door;

a dispenser positioned on the door; and a water line connected to the dispenser for delivering water to the dispenser, the water line positioned adjacent the second thermal battery and in direct contact with the second thermal battery such that water in the line is cooled by the second thermal battery as it passes the second thermal battery.

2. The refrigerator of claim 1, wherein the first thermal battery is positioned within the cabinet.

3. The refrigerator of claim 1, wherein the first thermal battery is positioned adjacent the thermoelectric cooler on the door.

4. The refrigerator of claim 1, further comprising a fan adjacent the first thermal battery to aid in cooling the thermal battery.

5. The refrigerator of claim 1, further comprising an ice making system positioned on the door, the ice making system including an ice maker, an ice container, and a cooling loop, the cooling loop in contact with the thermoelectric cooler and the ice maker.

* * * * *